US007751911B2

(12) United States Patent
Zhang

(10) Patent No.: US 7,751,911 B2
(45) Date of Patent: Jul. 6, 2010

(54) FAILURE ALARM DEVICE AND FAILURE ALARM METHOD

(75) Inventor: Yigang Zhang, Shanghai (CN)

(73) Assignee: Semiconductor Manufacturing International (Shanghai) Corporation, Shanghai (CN)

( * ) Notice: Subject to any disclaimer, the term of this patent is extended or adjusted under 35 U.S.C. 154(b) by 299 days.

(21) Appl. No.: 11/951,327

(22) Filed: Dec. 5, 2007

(65) Prior Publication Data

US 2008/0160878 A1 Jul. 3, 2008

(30) Foreign Application Priority Data

Dec. 28, 2006 (CN) ..... 2006 1 0148247

(51) Int. Cl.

| | |
|---|---|
| ***G05B 9/02*** | (2006.01) |
| ***G06F 19/00*** | (2006.01) |
| ***G06F 11/00*** | (2006.01) |
| ***H01L 21/00*** | (2006.01) |
| ***H01L 21/306*** | (2006.01) |
| ***G08B 5/22*** | (2006.01) |
| ***C23F 1/00*** | (2006.01) |

(52) U.S. Cl. ..... 700/80; 700/108; 700/121; 700/174; 714/48; 438/8; 340/825.36; 156/345.13

(58) Field of Classification Search ..... 700/79, 700/80, 95, 108–110, 117, 121, 174; 438/8, 438/10; 451/5, 8, 11, 156; 340/506, 507, 340/825.36; 210/85; 156/345.12, 345.13, 156/345.15; 714/47, 48

See application file for complete search history.

(56) References Cited

U.S. PATENT DOCUMENTS

| | | | | |
|---|---|---|---|---|
| 6,099,386 | A * | 8/2000 | Tsai et al. | 451/8 |
| 6,099,393 | A * | 8/2000 | Katagiri et al. | 451/56 |
| 6,254,767 | B1 * | 7/2001 | Shin et al. | 210/85 |
| 6,554,467 | B2 * | 4/2003 | Snyder et al. | 366/348 |
| 6,572,730 | B1 * | 6/2003 | Shah | 156/345.12 |
| 6,813,534 | B2 * | 11/2004 | Sui et al. | 700/121 |
| 6,895,293 | B2 * | 5/2005 | Reiss et al. | 700/110 |
| 6,988,934 | B1 * | 1/2006 | Lee et al. | 451/11 |
| 7,324,855 | B2 * | 1/2008 | Ushiku et al. | 700/83 |
| 2002/0013007 | A1 * | 1/2002 | Hasegawa et al. | 438/8 |

* cited by examiner

*Primary Examiner*—Crystal J Barnes-Bullock
(74) *Attorney, Agent, or Firm*—Squire, Sanders & Dempsey L.L.P.

(57) ABSTRACT

A failure alarm device includes: an operation instruction capturing unit; an operation status signal capturing unit; and a timing and alarming unit for starting timing when the operation instruction capturing unit captures a start-operation instruction and the operation status signal capturing unit captures an operation status signal indicative of that the CMP apparatus is in the preset operation status, and for alarming if a duration of the operation status signal indicative times out. During operation of the CMP apparatus, when there occurs an unexpected failure in a computer or control software or the CMP apparatus is powered off, an alarm can be initiated in a timely way so as to inform an apparatus engineer to obviate the failure, and wafer rejects in the CMP apparatus can be avoided. A failure alarm method is also provided.

14 Claims, 5 Drawing Sheets

FAILURE ALARM DEVICE AND FAILURE ALARM METHOD

CROSS-REFERENCE TO RELATED APPLICATION

This application claims the priority of Chinese Patent Application No. 200610148247.3, filed on Dec. 28, 2006, the disclosure of which is incorporated herein by reference.

FIELD OF THE INVENTION

The present invention relates to a failure alarm device and a failure alarm method, and in particular to a failure alarm device and a failure alarm method for a failure occurring in a polishing apparatus during a Chemical Mechanical Polishing (CMP) process.

BACKGROUND OF THE INVENTION

As the semiconductor industry develops continuously, semiconductor fabrication processes have stepped into the nanometer age. In compliance with the trend that various electronic products become smaller and smaller with more and more powerful capabilities, a fabrication procedure with an original line width of 0.18 μs has advanced to that with a current line width of 0.13 μs or even 90 nm and 65 nm.

Accompanying such a trend that a chip is provided with more and more powerful capabilities and a semiconductor element is made smaller and smaller, more and more demanding technical requirements have been imposed on various phrases in the fabrication procedure. Due to the smaller element and more complex internal circuits, the fabrication procedure becomes more sensitive to small changes in various parameters. After the element has been reduced considerably in size, an originally allowable error of a condition for the fabrication procedure may bring a great effect on performances of the element. Therefore, the requirements on the fabrication processes will necessarily tend to be demanding so as to achieve a good performance of the element.

The CMP process was introduced into the Integrated Circuit (IC) fabrication industry by IBM Corp. in 1984. Firstly, it was used for planarization of an inter-metal isolation dielectric (IMD) in a later process, and then was used for planarization of tungsten (W) thanks to apparatus and process improvements. Next, it was used for planarization of Shallow Trench Isolation (ISO) and copper (Cu). The CMP process is one technology with the most rapid growth and being paid most attention in the IC fabrication procedure.

At present, a precise computer control has been enabled fully for the CMP process. Unfortunately, during an operation of a CMP apparatus, a failure of a computer or control software may occur, such as a crash of the computer, a halt of the operation of the control software, an instruction error of the control software or the like, which can result in a stop of the operation of the CMP apparatus or in over-polishing a wafer. In the process conditions of the prior art, the apparatus can not alarm automatically when any of these failures occurs, and it is difficult for a maintenance staff to discover and obviate the failure upon occurring, which can give rise to a large number of direct wafer rejects in the CMP apparatus and thus effect the qualification rate.

In addition to this, a situation may occur although rarely in which a computer control system or the CMP apparatus is powered off unexpectedly, thus resulting in a stop of the operation of the apparatus. In such a case, wafers for which the CMP has not been finished may remain and thus may be eroded in a polishing liquid. If the apparatus failure can be discovered in a timely way, those wafers can be removed duly, and the loss due to the eroded wafers can be avoided. In this case, however, an alarm device if any would not work due to the system entirely powered off.

Similarly to the CMP process, the same cases may occur in other fabrication processes where a failure of the computer system or operation software controlling the operation of the apparatus can cause a failure of the operation of the apparatus as well as where the system entirely powered off can cause a failure of the operation of the apparatus. Currently, there is no a satisfactory control method in this regard.

SUMMARY OF THE INVENTION

Embodiments of the invention provide solutions by which when a computer system or software run by a conventional control device fails or the system is powered off unexpectedly, the failure can be discovered and obviated in a timely way.

To this end, an embodiment of the invention provides a failure alarm device including: an operation instruction capturing unit, adapted to capture a start-operation instruction for a CMP apparatus; an operation status signal capturing unit, adapted to capture an operation status signal indicative of whether the CMP apparatus is in a preset operation status; and a timing and alarming unit, adapted to start timing when the operation instruction capturing unit captures a start-operation instruction for the CMP apparatus and that the operation status signal capturing unit captures an operation status signal indicative of that the CMP apparatus is in the preset operation status, and adapted to alarm if a duration of the operation status signal indicative of being in the preset operation status times out.

Optionally, the operation instruction capturing unit, the operation status signal capturing unit and the timing and alarming unit are electrically connected in series; the operation instruction capturing unit turns on when a start-operation instruction for the CMP apparatus is captured; the operation status signal capturing unit turns on when an operation status signal is captured which is indicative that the CMP apparatus is in the preset operation status, and turns off when an operation status signal is captured which is indicative that the CMP apparatus quits the preset operation status.

Optionally, the operation instruction capturing unit and the operation status signal capturing unit are relays.

Optionally, the failure alarm device further includes an individual power source, and a switch adapted to connect or disconnect the failure alarm device.

Another embodiment of the invention provides a failure alarm method including the steps of: 1) capturing a start-operation instruction for a CMP apparatus; 2) capturing a signal indicative of operation status of the CMP apparatus; 3) determining whether the CMP apparatus is in a preset operation status based on the operation status signal; and 4) starting timing when the CMP apparatus is in the preset operation status, and determining whether a duration of the operation status signal indicative of being in the preset operation status times out, and alarming if the duration times out.

Optionally, the failure alarm method further includes the steps of: returning to step 2) if the CMP apparatus is not in the preset operation status; and returning to step 2) if the duration of the operation status signal indicative of being in the preset operation status does not time out.

Another embodiment of the invention provides a failure alarm device including: an operation instruction capturing unit, adapted to capture a start-operation instruction for a CMP apparatus; an operation status signal capturing unit, adapted to capture an operation status signal indicative of whether the CMP apparatus is in a preset operation status; a power-off signal capturing unit, adapted to capture a power-off signal of a CMP system; and a timing and alarming unit, adapted to start timing when the operation instruction capturing unit captures a start-operation instruction for the CMP apparatus and the an operation status signal capturing unit captures an operation status signal indicative that the CMP apparatus is in the preset operation status, and adapted to alarm if a duration of the operation status signal indicative of being in the preset operation status times out or the a power-off signal capturing unit captures the power-off signal of a CMP system.

Optionally, the operation instruction capturing unit, the operation status signal capturing unit and the timing and alarming unit are electrically connected in series; the power-off signal capturing unit is connected in parallel with the operation instruction capturing unit and the operation status signal capturing unit; the operation instruction capturing unit turns on when a start-operation instruction for the CMP apparatus is captured, the operation status signal capturing unit turns on when an operation status signal is captured which is indicative that the CMP apparatus is in the preset operation status, and turns off when an operation status signal is captured which is indicative that the CMP apparatus quits the preset operation status; and the power-off signal capturing unit is connected when the CMP system is powered normally, and is disconnected when the CMP system is powered off.

Optionally, the operation instruction capturing unit and the operation status signal capturing unit are relays.

Optionally, the failure alarm apparatus further includes a separate power supply, used to supply power, and a switch adapted to connect or disconnect the failure alarm device.

A further embodiment of the invention provides a failure alarm method including the steps of: 1) capturing a signal indicative that a CMP system is powered normally; 2) capturing a start-operation instruction for a CMP apparatus; 3) capturing a signal indicative of operation status of the CMP apparatus; 4) determining whether the CMP apparatus is in a preset operation status based on the operation status signal; and 5) starting timing when the CMP apparatus is in the preset operation status, and determining whether a duration of the operation status signal indicative of being in the preset operation status times out, and alarming if the duration times out; when the CMP system is powered normally, a timing and alarming unit operating in accordance with a captured signal indicative of operation status of the CMP apparatus; and when the CMP system is powered off, for the timing and alarming unit being operative to alarm.

Optionally, the failure alarm method further includes the steps of: returning to step 3) if the CMP apparatus is not in the preset operation status; and returning to step 3) if the duration of the operation status signal indicative of being in the preset operation status does not time out.

The embodiments are advantageous over the prior art in the following aspects.

During the operation of the CMP apparatus, when an unexpected failure occurs in the computer or control software, the failure alarm device can alarm and inform an engineer to obviate the failure, and thus wafer rejects in the CMP apparatus can be avoided.

Also when the CMP apparatus is powered off, the failure alarm device can alarm in a timely way so as to inform an engineer to obviate the failure, and thus wafer rejects in the CMP apparatus can be avoided.

The failure alarm method can be implemented through hardware or software, and when an unexpected failure occurs in the computer or control software, or when the CMP system is powered off unexpectedly, the failure alarm method can alarm in a timely way so as to inform an engineer to obviate the failure, and thus wafer rejects in the CMP apparatus can be avoided.

DETAILED DESCRIPTION OF THE EMBODIMENTS

Figure 1:
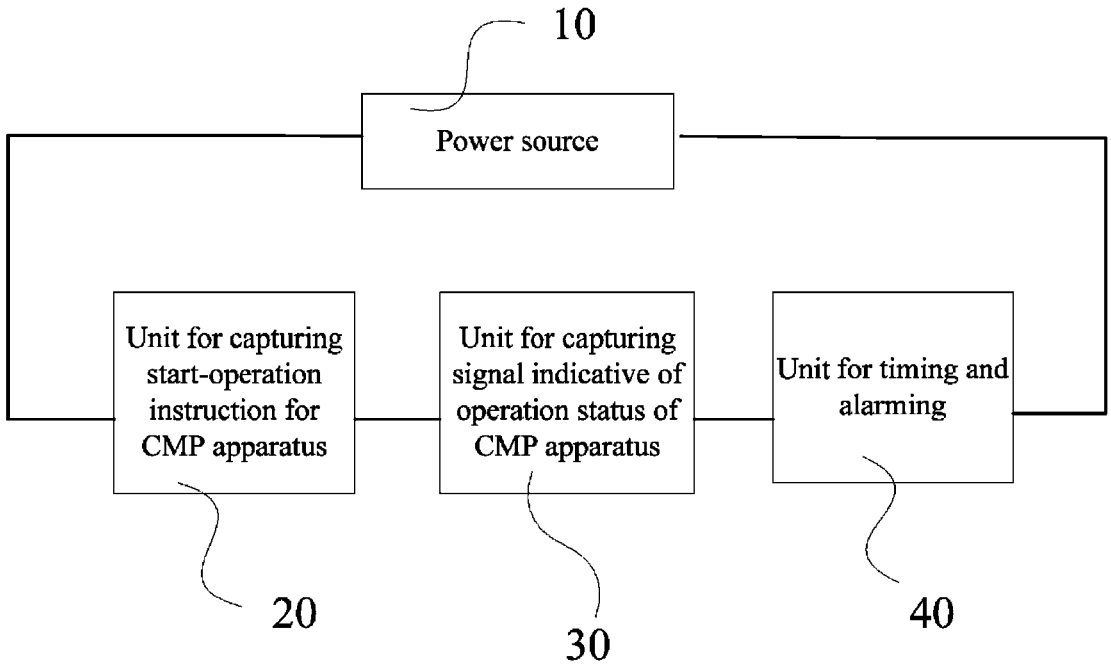
FIG. 1 shows a structural diagram of a failure alarm device according to a first embodiment of the invention.

Embodiments of the invention provide a failure alarm device in which a signal indicative of operation status of a CMP apparatus can be captured through a relay so as to monitor an operation status of the CMP apparatus during a process of fabricating a semiconductor device, and an alarm device can be started when the operation status the CMP apparatus indicated by the signal does not conform to a predefined standard status so as to facilitate a human operator to discover and obviate a failure.

Exemplary implementations of the invention will be described in details hereinafter with reference to the drawing and the embodiments.

The First Embodiment

According to the first embodiment, there is provided a failure alarm device including: an operation instruction capturing unit, which is adapted to capture a start-operation instruction for a CMP apparatus; an operation status signal capturing unit, which is adapted to capture an operation status signal indicative of whether the CMP apparatus is in a preset operation status; a timing and alarming unit, which is adapted to start timing when the operation instruction capturing unit captures a start-operation instruction for the CMP apparatus and the operation status signal capturing unit captures an operation status signal indicative that the CMP apparatus is in the preset operation status, and adapted to alarm if a duration of the operation status signal indicative of being in the preset operation status times out.

The failure alarm device can use software to capture the start-operation instruction for the CMP apparatus and the operation status signal, to achieve timing for the operation status signal, and to determine that the operation status signal times out and thus alarm. Alternatively, those functions can be enabled through a hardware circuit or a combination of software and hardware. Those units included in the failure alarm device in this embodiment are implemented through a serial electrical connection with each other.

Referring to FIG. 1, there is illustrated a failure alarm device implemented through hardware in an embodiment, in which an operation instruction capturing unit, an operation status signal capturing unit and a timing and alarming unit are electrically connected in series. Particularly, the operation instruction capturing unit turns on when a start-operation instruction for the CMP apparatus is captured, and the operation status signal capturing unit turns on when an operation status signal is captured which is indicative that the CMP apparatus is in the preset operation status, and turns off when an operation status signal is captured which is indicative that the CMP apparatus quits the preset operation status.

As illustrated in FIG. 1, the failure alarm device includes a power source 10, preferably a individual power source that needs not to be connected to a conventional 220V AC power source. In an embodiment, a 24V individual DC power source is used to supply power.

The device illustrated in FIG. 1 also includes an operation instruction capturing unit 20. A CMP apparatus manufactured by U.S. Application Material Corp is used in this embodiment. Typically, the CMP apparatus is provided with several relays which are idle for a while to facilitate improvement of the CMP apparatus. These relays can be controlled directly through control software controlling operation of the CMP apparatus. Thus, the operation instruction capturing unit 20 is one of relays provided for the CMP apparatus, such as a relay of Model DOS-31. The operation status of the CMP apparatus in operation can be captured through the control software controlling the operation of the CMP apparatus.

In a practical CMP process, the CMP apparatus is started upon receipt of an instruction "Start Operation" issued from the control software, and then the CMP process begins. According to the embodiment, the operation instruction capturing unit 20 communicates with the control software of the CMP apparatus via an input and output circuit board (DI/O board) of the CMP apparatus. After the instruction "Start Operation" issued from the control software is captured, the operation instruction capturing unit 20 turns on. When an instruction "Stop Operation" is received from the control software, the operation instruction capturing unit 20 turns off.

Alike, an operation status signal capturing unit 30 is also one of relays provided for the CMP apparatus, and communicates with the control software of the CMP apparatus via the input and output circuit board (DI/O board) of the CMP apparatus. After the CMP apparatus enters a preset operation status, the operation status signal capturing unit 30 turns on, and after the CMP apparatus quits the preset operation status, the operation status signal capturing unit 30 turns off. When the CMP apparatus re-enters the preset operation status, the operation status signal capturing unit 30 turns on again.

In various embodiments of the invention, a signal indicative of operation status of the CMP apparatus in the CMP process may include a signal indicative of pressing down or lifting of a substrate in the CMP apparatus for placing a wafer thereon, a pressure signal of a polishing head, a rotation signal of a polishing head, a vacuum status signal of a vacuum chamber, etc. Each of those signals can reflect an operation status of the CMP apparatus, and when the operation status of the CMP apparatus changes, a possible failure may occur in the operation of the CMP apparatus, and the failure alarm device is started by capturing the above operation status to obviate the failure of the apparatus.

In an embodiment, the operation status signal capturing unit 30 is adapted to capture the signal indicative of pressing down or lifting of a substrate in the CMP apparatus for placing a wafer thereon. When the substrate for placing a wafer thereon in the CMP apparatus is pressed down, the CMP process begins, and the operation status signal capturing unit 30 turns on, and when one CMP process ends, the substrate for placing a wafer thereon is lifted, and the operation status signal capturing unit 30 turns off.

A timing and alarming unit 40 is also connected in the failure alarm device of the embodiment, which can be any conventional means for timing and alarming available in the current market or an alarm connected in series with a timer. A timer of Model JSS48A manufactured by XinLing Electronics Joint-Stock Ltd. of China and an alarm of Model HRV-P80 manufactured by Nanzhou Ltd. of Zhejiang Province can be used in the embodiment. Various alarm sounds can be set freely for such an alarm, that is, different alarm sounds can be set dependent upon different reasons for a failure.

While the operation status signal capturing unit 30 is used to capture a signal indicative of pressing down or lifting of the substrate in the CMP apparatus for placing a wafer thereon, the failure alarm device is during its operation. First, the power source 10 is switched on, and when the control software of the CMP apparatus issues an instruction "Start Operation", the operation instruction capturing unit 20 turns on, and when the CMP apparatus begins to perform the CMP process, the substrate for placing a wafer thereon is pressed down on a polishing pad, and a polishing process is started. At this time, the operation status signal capturing unit in the CMP apparatus 30 turns on, and the timing and alarming unit 40 starts timing when the substrate for placing a wafer thereon is pressed down onto the polishing pad. Normally, the process period of time during which the substrate for placing a wafer thereon, which has been pressed down onto the polishing pad, is polished is preset as a fixed period of time t1. Therefore, a period of time t2 prescribed by the automatic timer should be slightly longer than the process period of time t1, preferably t2=t1+(5~10 seconds). If the timer passes t2, then the timing and alarming unit 40 alarms automatically.

When the substrate for placing a wafer thereon is pressed down onto the polishing pad, the operation status signal capturing unit 30 turns on. Thus the failure alarm device is enabled, and the timer in the timing and alarming unit 40 starts timing. If no failure occurs in the CMP process, that is, the CMP process begins and ends in accordance with the preset process period of time, then upon completion of the CMP process, the substrate for placing a wafer thereon is lifted away from the polishing pad, and the wafer is transferred to a subsequent clearing process. When the substrate for placing a wafer thereon is lifted up from the polishing pad, the operation status signal capturing unit 30 turns off automatically, thus the failure alarm device is disconnected and the timer is automatically cleared to zero. When the substrate for placing a wafer thereon is pressed down onto the polishing pad, and the CMP process begins for a next wafer, the operation status signal capturing unit 30 turns on again, the failure alarm device 40 is enabled, and the timer starts timing. While the CMP process proceeds in accordance with a preset normal process, the timing and alarming unit 40 performs timing and reset cyclically as the process proceeds.

If in the CMP polishing process, a failure, such as a halt of the control software or a crash of the computer, occurs with respect to the substrate for placing a wafer thereon, and thus a period of time during which the substrate for placing a wafer thereon becomes longer than the preset period of time t1, then the timer proceeds with timing. When the timer reaches an alarm time preset by the timer, an alarm is issued so that an apparatus engineer and a CMP process engineer can discover and obviate the failure in a timely way, and wafer rejects in the CMP apparatus can be avoided.

Figure 2:
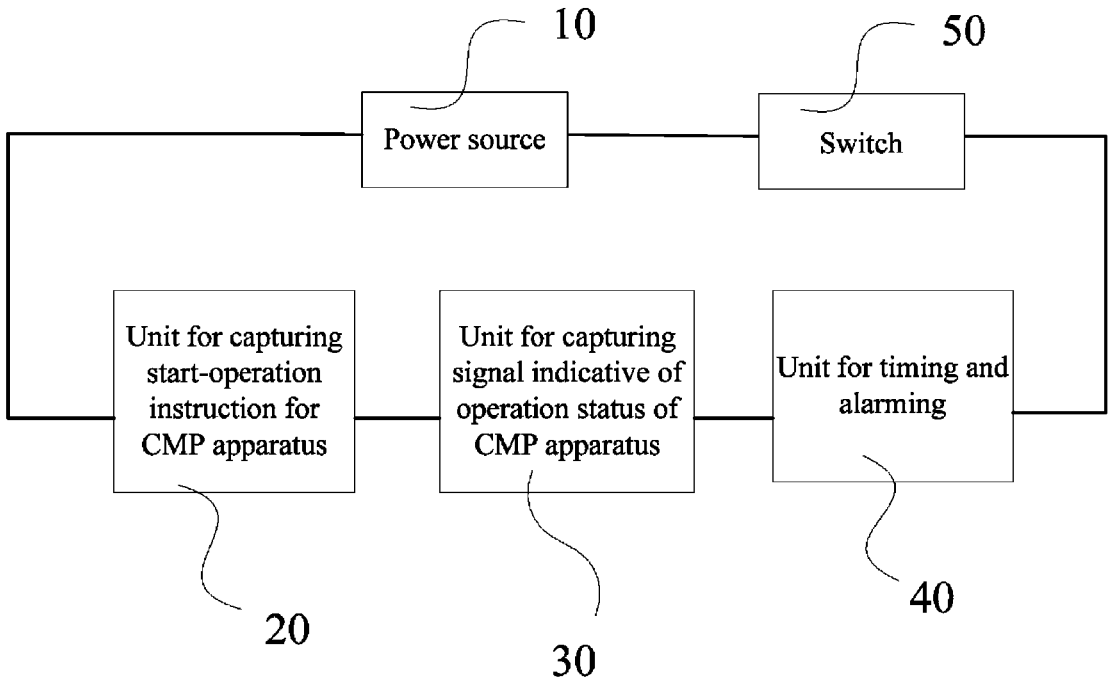
FIG. 2 shows a structural diagram of another failure alarm device according to the first embodiment of the invention.

Referring to FIG. 2, in which a preferred embodiment of the invention is illustrated, there is provided a failure alarm device including a power source 10, an operation instruction capturing unit 20, an operation status signal capturing unit 30, a timing and alarming unit 40 and a switch 50, where the switch can be connected in series at any place of the failure alarm device and is usually closed so that the failure alarm device is connected. In some cases, however, where, for example, a technical staff is maintaining the CMP apparatus but the substrate for placing a wafer thereon is kept in a press-down status, the operation status signal capturing unit 30 is in a turn-on status, and the entire failure alarm device turns on, thus during maintenance, the alarm may keep ON unless the entire failure alarm device is disconnected. For this reason, the switch 50 is connected at the failure alarm device as illustrated in FIG. 2, so that in a certain situation, the failure alarm device can be disconnected with human intervention to prevent the alarm from sending an erroneous alarm signal. In an embodiment, the switch 50 is preferably a manual switch, which can be directly opened when needed, easy to be operated with low cost.

Figure 3:
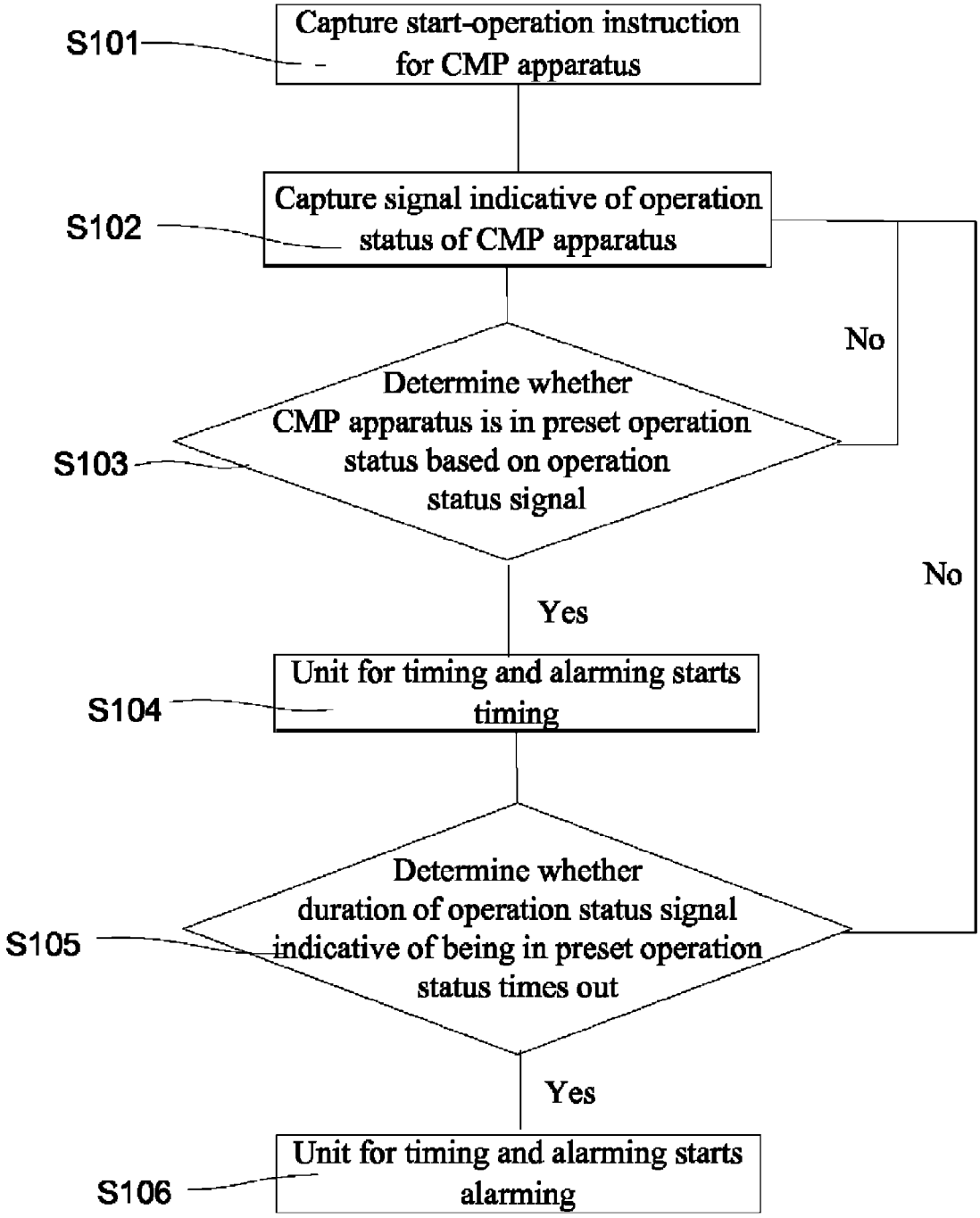
FIG. 3 shows a flow chart of a failure alarm method according to the first embodiment of the invention.

Correspondingly, reference to FIG. 3, there is provided a failure alarm method according to an embodiment of the invention, which includes the following steps. In step S101, a start-operation instruction for the CMP apparatus is captured; in Step 102, an operation status signal for the CMP apparatus is captured; in Step 103, it is determined based on the operation status signal whether the CMP apparatus is in a preset operation status, and if the CMP apparatus is not in the preset operation status, then the processing returns to step S102, otherwise the process goes to step S104 where the timing and alarming unit starts timing; in step S105, it is determined whether a duration of the operation status signal indicative of being in the preset operation status times out, and if the duration times out, the process goes to step S106 where the timing and alarming unit starts alarming, otherwise the processing returns to step S102 where the process proceeds with capturing an operation status signal for the CMP apparatus and resets the timer of the timing and alarming unit.

If the timing and alarming unit alarms continuously, it can be disconnected with human intervention.

The Second Embodiment

In the CMP process, such a situation sometimes may occur in which the entire operation system or the control system may be powered off completely. Due to power-off of entire circuits used by the CMP apparatus, the CMP apparatus may cease its operation, and an alarm provided if any for an external system can not work due to the power-off. For this reason, according to the second embodiment, there is provided another failure alarm device including: an operation instruction capturing unit, which is adapted to capture a start-operation instruction for a CMP apparatus; an operation status signal capturing unit, which is adapted to capture an operation status signal indicative of whether the CMP apparatus is in a preset operation status; a power-off instruction capturing unit, which is adapted to capture a power-off signal for the CMP apparatus; a timing and alarming unit, which is adapted to start timing when the operation instruction capturing unit captures a start-operation instruction for the CMP apparatus and the operation status signal capturing unit captures an operation status signal indicative of that the CMP apparatus is in the preset operation status, and adapted to alarm if a duration of the operation status signal indicative of being in the preset operation status times out or the power-off signal capturing unit captures the power-off signal for the CMP apparatus.

The failure alarm device can use software to capture a start-operation instruction for the CMP apparatus and an operation status signal, to achieve timing for the operation status signal, and to determine if the operation status signal times out and if yes, alarm. Alternatively, those functions can be achieved through a hardware circuit or a combination of software and hardware. The units included in the failure alarm device in this embodiment are implemented through a serial electrical connection with each other.

Figure 4:
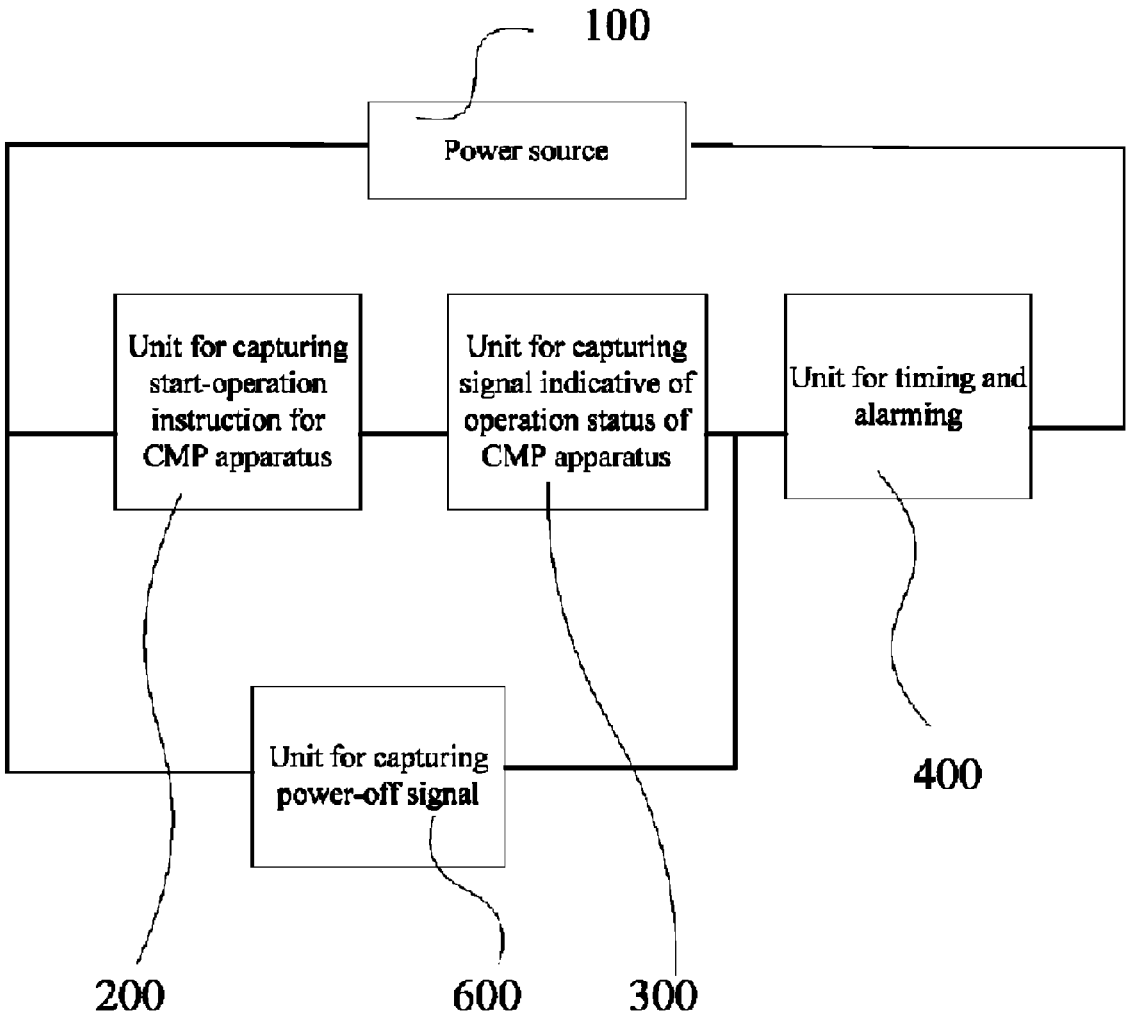
FIG. 4 shows a structural diagram of a failure alarm device according to a second embodiment of the invention.

Referring to FIG. 4, there is illustrated a failure alarm device implemented through hardware in an embodiment, in which an operation instruction capturing unit, an operation status signal capturing unit and a timing and alarming unit are electrically connected in series, and a power-off signal capturing unit is electrically connected in parallel with the operation instruction capturing unit and the operation status signal capturing unit. Particularly, the operation instruction capturing unit turns on when a start-operation instruction for the CMP apparatus is captured; the operation status signal capturing unit turns on when an operation status signal is captured which is indicative that the CMP apparatus is in the preset operation status, and turns off when an operation status signal is captured which is indicative that the CMP apparatus quits the preset operation status; and the power-off signal capturing unit turns off when the CMP system is powered normally, and turns on when the CMP system is powered off.

Referring to FIG. 4, in which an embodiment of the invention is illustrated, the failure alarm device as illustrated includes a power source 100, preferably an individual power source that needs not to be connected to a conventional 220V AC power source. In an embodiment, a 24V individual DC power source is used to supply power.

The device illustrated in FIG. 4 also includes an operation instruction capturing unit 200, which is one of several relays provided for the CMP apparatus, as previously discussed with reference to the first embodiment. After the instruction "Start Operation" issued from the control software is captured, the operation instruction capturing unit 200 turns on.

An operation status signal capturing unit 300 is also one of relays provided for the CMP apparatus, as previously discussed with reference to the first embodiment. After the CMP apparatus enters a preset operation status, the operation status signal capturing unit 300 turns on, and after the CMP apparatus quits the preset operation status, the operation status signal capturing unit 300 turns off.

The failure alarm device of the second embodiment also includes a timing and alarming unit 400, which can be any conventional means for timing and alarming available in the current market, or can be an alarm connected in series with a timer. The timing and alarming unit 400 used in this embodiment is as previously discussed with reference to the first embodiment.

In the failure alarm device of the embodiment, there is also provided a power-off signal capturing unit 600, which is a normally-closed relay provided for the CMP apparatus. Normally, the power-off signal capturing unit 600 is open. When the entire CMP system is powered off, the power-off signal capturing unit 600 turns on. The power-off signal capturing unit 600 communicates with the control software of the CMP apparatus via an input and output circuit board (DI/O board) of the CMP apparatus.

When the entire CMP system is powered on, since the power-off signal capturing unit 60 is open, the failure alarm device of this embodiment is actually identical to that of the first embodiment, which is equivalent to that the power source 100, the operation instruction capturing unit 200, the operation status signal capturing unit 300 and a timing and alarming unit 400 are connected in series, and thus the same failure alarm mechanism and operation principle as the first embodiment may apply to the failure alarm device of this embodiment.

When the entire system is powered off, the power source used in the embodiment is an individual power source used to supply power independently, and thus does not have influence on the operation of the failure alarm device. Since the entire system is powered off, the operation instruction capturing unit 200 and the operation status signal capturing unit 300 are off due to failing to capturing a signal, and only the power-off signal capturing unit 600 is in a turn-on status. Thus, the failure alarm device of the embodiment is equivalent to the power source 100, the power-off signal capturing unit 600 and the timing and alarming unit 400 connected in series with each other, thus the alarm will issue alarm information.

Figure 5:
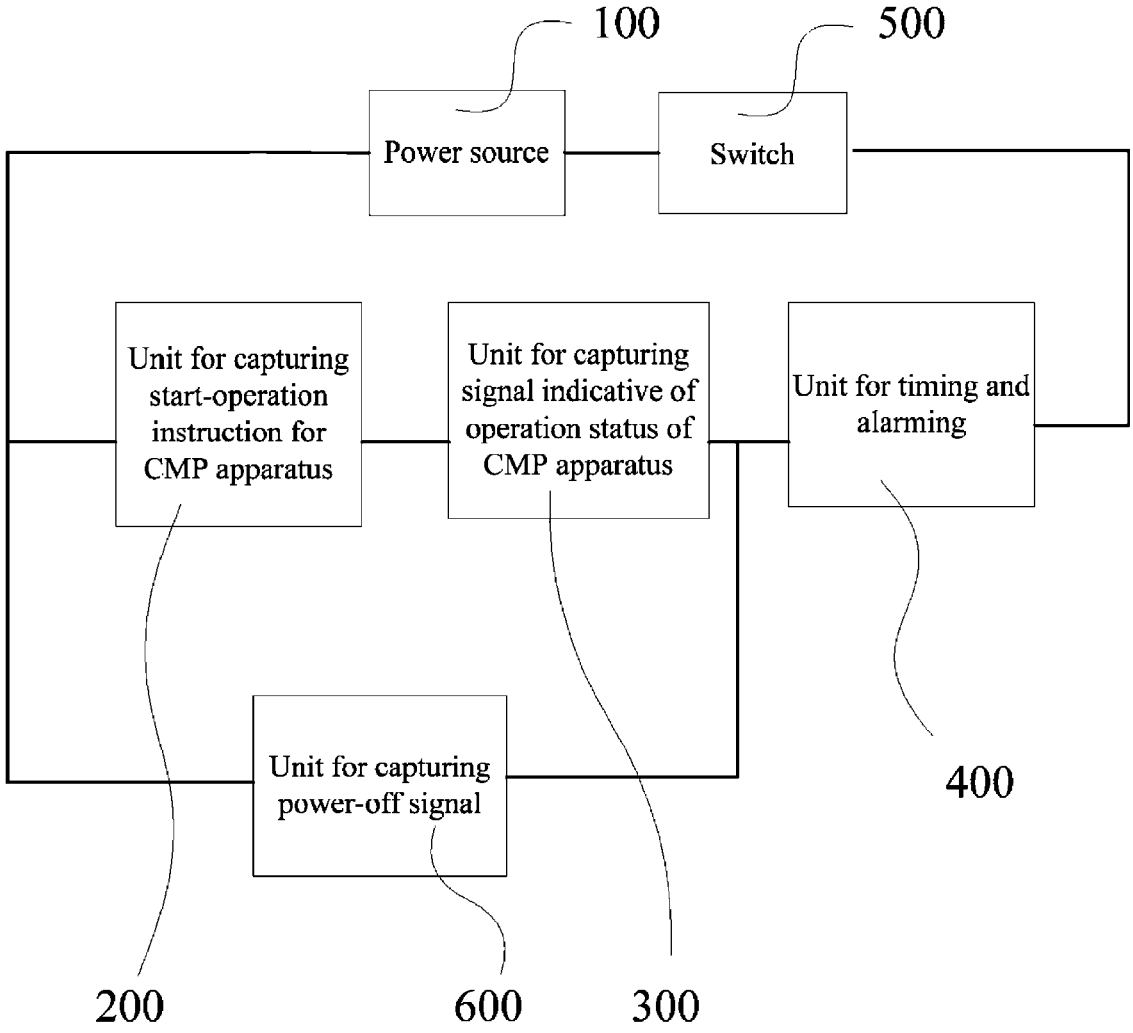
FIG. 5 shows a structural diagram of another failure alarm device according to the second embodiment of the invention.

Referring to FIG. 5, in which another preferred embodiment of the invention is illustrated, there is provided a failure alarm device including an operation instruction capturing unit 200, an operation status signal capturing unit 300, a timing and alarming unit 400, a powering-off signal capturing unit 600, and a switch 500 which is connected in series with the timing and alarming unit 400.

Normally, the switch 500 is closed in order to ensure turn-on of the failure alarm device. However, in some cases where, for example, a technical staff maintains the CMP apparatus when the CMP apparatus is in operation and the operation status signal capturing unit 300 is in a turn-on status, the failure device entirely is ON, and during the maintenance, the alarm may keep alarming unless the failure alarm device is disconnected. For this reason, the switch 500 is added in the failure alarm device as illustrated in FIG. 4, so that in a certain situation, the failure alarm device can be disconnected with human intervention to prevent the alarm from sending an erroneous alarm signal.

Furthermore, when the entire system is powered off, the alarm may keep in an alarm status. When the technical staff discovers the information on the power-off of the system, the switch 500 may be closed to prevent the alarm from keeping in an alarm status.

In an embodiment, the switch 50 is preferably a manual switch, which can be directly switched off when needed, easy to be operated with low cost.

Figure 6:
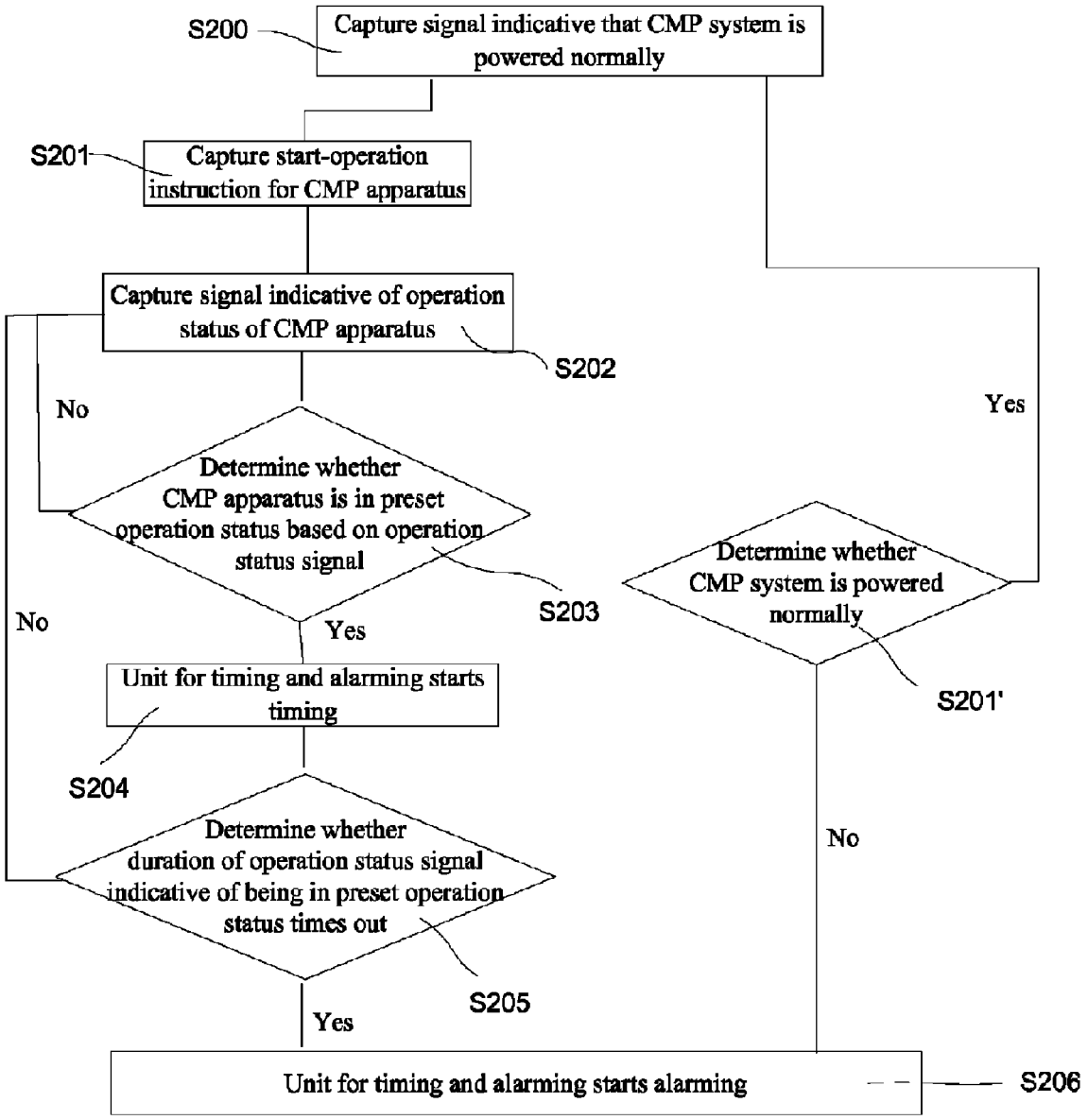
FIG. 6 shows a flow chart of a failure alarm method according to the second embodiment of the invention.

Correspondingly, there is provided in which a failure alarm method according to an embodiment of the invention, refer to FIG. 6. The method includes the following steps: step S200, a signal is captured which is indicative that the CMP system is powered normally, and then the processing goes to step S201' where it is determined whether the system is powered normally, and if it is powered normally, the processing proceeds with step S200, otherwise the processing goes to step S206 where the timing and alarming unit starts alarming; following step S200 where the signal is captured which is indicative that the CMP system is powered normally, the processing goes to step S201 where a start operation instruction for the CMP apparatus is captured; thereafter, the processing goes to step S202 where a signal indicative of operation status signal of the CMP apparatus is captured; in step S203, it is determined based on the operation status signal of the CMP apparatus whether the CMP apparatus is in a preset operation status, and if the CMP apparatus is not in the preset operation status, the processing goes to step S202, otherwise the processing goes to step S204 where the timing and alarming unit starts timing, and then to step S205 where it is determined whether a duration of the operation status signal indicative of being in the preset operation status times out, and if it times out, the processing goes to step S206 where the timing and alarming unit starts alarming, otherwise the processing returns to step S202 where the processing proceeds with capturing an operation status signal for the CMP apparatus and resets the timer of the timing and alarming unit.

If the timing and alarming unit alarms continuously, it can be switched off with human intervention.

Although the present invention has been disclosed with reference to the embodiments thereof and the drawings, it shall be appreciated by those skilled in the art that various modifications and variations can be made therein without departing from the spirit and scope of the present invention as defined in the accompanying claims.

What is claimed is:

1. A failure alarm device, comprising:

an operation instruction capturing unit, adapted to capture a start-operation instruction for a Chemical Mechanical Polishing (CMP) apparatus;

an operation status signal capturing unit, adapted to capture an operation status signal indicative of whether the CMP apparatus is in a preset operation status, wherein the operation status signal comprises a signal indicative of pressing down or lifting of a substrate in the CMP apparatus for placing a wafer thereon, and wherein the preset operation status means the operation status in which a substrate in the CMP apparatus for placing a wafer thereon is pressed down and when the substrate in the CMP apparatus for placing a wafer thereon is lifted, it quits the preset operation status; and a timing and alarming unit, adapted to start timing when the operation instruction capturing unit captures a start-operation instruction for the CMP apparatus and the operation status signal capturing unit captures an operation status signal indicative that the CMP apparatus is in a preset operation status, and adapted to alarm if a duration of the operation status signal indicative of the CMP apparatus being in the preset operation status times out.

2. The failure alarm device according to claim 1, wherein the operation instruction capturing unit, the operation status signal capturing unit and the timing and alarming unit are electrically connected in series, and wherein the operation instruction capturing unit turns on when a start-operation instruction for the CMP apparatus is captured, and the operation status signal capturing unit turns on when an operation status signal is captured which is indicative that the CMP apparatus is in the preset operation status, and turns off when an operation status signal is captured which is indicative that the CMP apparatus quits the preset operation status.

3. The failure alarm device according to claim 2, wherein the operation instruction capturing unit and the operation status signal capturing unit are relays.

4. The failure alarm device according to claim 1 further comprising a switch adapted to disconnect the failure alarm device.

5. A failure alarm method, comprising:

1) capturing a start-operation instruction for a Chemical Mechanical Polishing (CMP) apparatus;

2) capturing a signal indicative of operation status of the CMP apparatus;

3) determining, based on the operation status signal, whether the CMP apparatus is in a preset operation status, wherein the operation status signal comprises a signal indicative of pressing down or lifting of a substrate in the CMP apparatus for placing a wafer thereon, and wherein the preset operation status means the operation status in which a substrate in the CMP apparatus for placing a wafer thereon is pressed down and when the substrate in the CMP apparatus for placing a wafer thereon is lifted, it quits the preset operation status; and 4) starting timing when the CMP apparatus is in the preset operation status, and, determining whether a duration of the operation status signal indicative of the CMP apparatus being in the preset operation status times out, and alarming if the duration times out.

6. The failure alarm method according to claim 5, further comprising:

returning to step 2) when the CMP apparatus is not in the preset operation status; and returning to step 2) when the duration of the operation status signal indicative of the CMP apparatus being in the preset operation status does not time out.

7. The failure alarm method according to claim 5, wherein when the timing and alarming unit alarms continuously, a switch can be used to stop it from alarming

8. A failure alarm device, comprising:

an operation instruction capturing unit, adapted to capture a start-operation instruction for a Chemical Mechanical Polishing (CMP) apparatus;

an operation status signal capturing unit, adapted to capture an operation status signal indicative of whether the CMP apparatus is in a preset operation status, wherein the operation status signal comprises a signal indicative of pressing down or lifting of a substrate in the CMP apparatus for placing a wafer thereon, and wherein the preset operation status means the operation status in which a substrate in the CMP apparatus for placing a wafer thereon is pressed down and when the substrate in the CMP apparatus for placing a wafer thereon is lifted, it quits the preset operation status;

a power-off signal capturing unit, adapted to capture a power-off signal of a CMP system; and a timing and alarming unit, adapted to start timing when the operation instruction capturing unit captures a start-operation instruction for the CMP apparatus and the operation status signal capturing unit captures an operation status signal indicative that the CMP apparatus is in the preset operation status, and adapted to alarm when a duration of the operation status signal indicative of the CMP apparatus being in the preset operation status times out or the power-off signal capturing unit captures the power-off signal of a CMP system.

9. The failure alarm device according to claim 8, wherein the operation instruction capturing unit, the operation status signal capturing unit and the timing and alarming unit are electrically connected in series, and the power-off signal capturing unit is connected in parallel with the operation instruction capturing unit and the operation status signal capturing unit; and wherein the operation instruction capturing unit turns on when a start-operation instruction for the CMP apparatus is captured, the operation status signal capturing unit turns on when an operation status signal is captured which is indicative that the CMP apparatus is in the preset operation status, and turns off when an operation status signal is captured which is indicative that the CMP apparatus quits the preset operation status, and the powering-off signal capturing unit turns off when the CMP system is powered normally, and turns on when the CMP system is powered off.

10. The failure alarm device according to claim 9, wherein the operation instruction capturing unit, the operation status signal capturing unit and the power-off signal capturing unit are relays.

11. The failure alarm device according to claim 8 further comprising a switch adapted to disconnect the failure alarm device.

12. A failure alarm method, comprising:

1) capturing a signal indicative that a Chemical Mechanical Polishing (CMP) system is powered normally;

2) capturing a start-operation instruction for a CMP apparatus;

3) capturing a signal indicative of operation status of the CMP apparatus;

4) determining, based on the operation status signal, whether the CMP apparatus is in a preset operation status, wherein the operation status signal comprises a signal indicative of pressing down or lifting of a substrate in the CMP apparatus for placing a wafer thereon, and wherein the preset operation status means the operation status in which a substrate in the CMP apparatus for placing a wafer thereon is pressed down and when the substrate in the CMP apparatus for placing a wafer thereon is lifted, it quits the preset operation status; and 5) starting timing if the CMP apparatus is in the preset operation status, and determining whether a duration of the operation status signal indicative of being in the preset operation status times out, and alarming if the duration times out; when the CMP system is powered normally, a timing and alarming unit operating in accordance with a captured signal indicative of operation status of the CMP apparatus and alarming when the CMP system is powered off.

13. The failure alarm method according to claim 12, further comprising:

returning to step 3) when the CMP apparatus is not in the preset operation status; and returning to step 3) if the duration of the operation status signal indicative of the CMP apparatus being in the preset operation status does not time out.

14. The failure alarm method according to claim 12, wherein when the timing and alarming unit alarms continuously, a switch can be used to stop it from alarming.

* * * * *